United States Patent [19]

Mal et al.

[11] 3,966,423

[45] June 29, 1976

[54] GRAIN REFINEMENT OF TITANIUM CARBIDE TOOL STEEL

[75] Inventors: M. Kumar Mal, Road, Spring Valley, N.Y. Stuart E. Tarkan, Monsey, N.Y.

[73] Assignee: Chromalloy American Corporation, New York, N.Y.

[22] Filed: Nov. 6, 1973

[21] Appl. No.: 413,339

[52] U.S. Cl. ..... 29/182.7; 29/182.8; 75/203; 75/204; 75/123 J; 75/123 M

[51] Int. Cl.[2] ..... B22F 3/00

[58] Field of Search ..... 75/203, 204, 123 J, 75/123 M; 29/182.7, 182.8

[56] References Cited

UNITED STATES PATENTS

| | | | |
|---|---|---|---|
| 2,828,202 | 3/1958 | Goetzel et al. | 75/203 |
| 3,369,891 | 2/1968 | Tarkan et al. | 75/123 |
| 3,492,101 | 1/1970 | Prill et al. | 29/182.7 |
| 3,651,934 | 2/1971 | Steven | 29/182.7 |
| 3,653,982 | 4/1972 | Prill | 29/182.5 |
| 3,720,504 | 3/1973 | Frehn | 29/182.7 |
| 3,723,077 | 3/1973 | Frehn | 29/182.7 |

FOREIGN PATENTS OR APPLICATIONS

| | | |
|---|---|---|
| 1,074,405 | 7/1967 | United Kingdom |

*Primary Examiner*—Richard D. Lovering
*Assistant Examiner*—B. Hunt

[57] ABSTRACT

A sintered steel-bonded titanium carbide composition characterized by an improved combination of physical and anti-friction properties is provided comprising about 15% to 60% by weight of primary grains of titanium carbide dispersed through a steel matrix making up essentially the balance, the steel matrix being characterized metallographically by an austenitic decomposition product, said steel-bonded titanium carbide composition containing an effective amount of a grain-growth inhibitor ranging by weight from about 0.25% to 2% of a columbium-group carbide.

16 Claims, 2 Drawing Figures

GRAIN REFINEMENT OF TITANIUM CARBIDE TOOL STEEL

Figure 1:
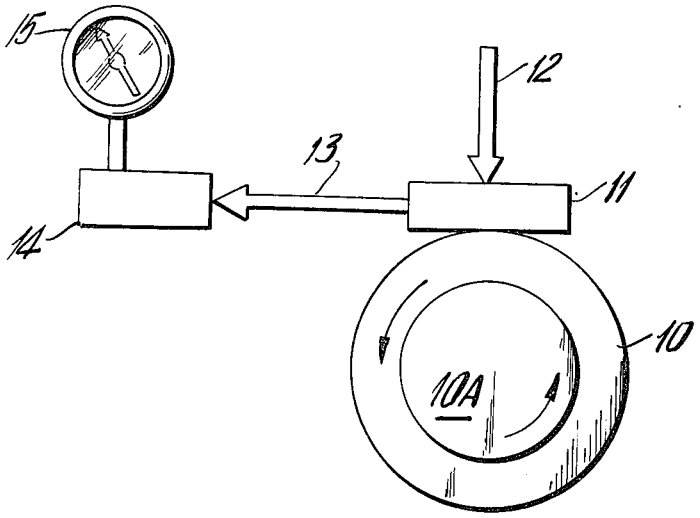

This invention relates to a sintered steel-bonded titanium carbide composition and to a method of producing the same, and to a hardened wear resistant element produced from said composition characterized by an improved combination of mechanical properties, including improved anti-friction properties, and the like.

STATE OF THE ART

The production of steel-bonded titanium carbide compositions by liquid phase sintering generally results in a microstructure in which the titanium carbide grains have an average size of over 5 microns. In producing a part, the titanium carbide grains (e.g. 3 to 8 microns in size) are mixed with powdered steel-forming ingredients to form the matrix, then compacted to the desired shape and the shape sintered at a temperature above the melting point of the matrix, for example, at a temperature ranging up to about 250°F (120°C) above the melting point of the matrix. Because of the complex liquid phase sintering mechanisms involved during the fabrication process, there is a tendency for the titanium carbide grains to grow to relatively coarse sizes. A coarse grain size is to be avoided as the presence of such grains has an adverse effect upon the mechanical properties of the sintered composition, such as transverse rupture strength, impact strength and the like. Generally, such compositions also tended to exhibit relatively high coefficient of friction when used as a sliding wear resistant seal component in, for example, the rotary combustion engine, e.g. the Wankel engine.

The development of the rotary combustion engine has aroused a great deal of interest in automotive circles and indications are that the large automotive companies have committed themselves to putting cars on the road in the near future powered by such engines.

However, industry is faced with many problems concerning the successful use of such engines. For example, extensive tests to date have pointed up the necessity of providing improved sophisticated seal materials to meet the stringent demands of the rotary engine. A very important and critical component of the engine is the "apex seal" which serves the purpose on the rotary piston of sealing off the various compartments of the trochoidal chamber within the housing. These seals which are subjected to heat, oxidation, and to wear by abrasion, must be capable of exhibiting durability and reliability for at least 100,000 miles of operation and should exhibit the required combination of physical and chemical properties, such as resistance to oxidation and corrosion at elevated temperatures, high transverse rupture strength, good resistance to impact, and good anti-friction properties (that is to say, low sliding friction) so as to provide the desired resistance to wear and the like. Moreover, the seal material must exhibit adequate compatibility against the trochoidal surface of the engine chamber which is usually coated with a wear resistant material, such as chromium and "Elnisil" (trademark). The latter material is a coating composition comprising 5% by weight of finely divided silicon carbide uniformly dispersed through a matrix of an electroplate of nickel.

A sintered steel-bonded titanium carbide tool steel composition which has been proposed for apex seals is one comprising about 45v/o (about 33% by weight) of primary grains of titanium carbide dispersed through a steel matrix making up essentially the balance, the matrix containing by weight about 10% Cr, 3% Mo, 0.85% C and the balance iron. While this composition has shown very promising results, further demands by development engineers have placed particularly heavy emphasis on materials exhibiting higher resistance to thermal shock, lower sliding friction within the trochoidal chamber and hence greater resistance to wear, and such improved mechanical properties as higher resistance to impact and higher transverse rupture strength.

It should be added that tooling and component part manufacturers also have been constantly seeking newer and better materials capable of withstanding stresses, thermal shock, impact, heat and wear encountered in certain hot work and impact-involving applications, such as warm heading dies, swedging dies, forging dies, die casting tools, and the like. These demands have likewise created an urgent need for steel-bonded titanium carbide material having a unique combination of physical and mechanical properties at room and elevated temperatures, including improved resistance to impact combined with improved transverse rupture strength.

We have now found that by adding an effective amount of a grain-growth inhibitor to the composition, we can meet the foregoing objectives and provide steel-bonded titanium carbide compositions having a refined grain size of less than 5 microns average size.

OBJECTS OF THE INVENTION

It is thus the object of the invention to provide a sintered steel-bonded titanium carbide composition characterized by a refined grain structure and by an improved combination of mechanical properties.

Another object is to provide as an article of manufacture a wear resistant element formed of a sintered hardened steel-bonded titanium carbide composition characterized metallographically by a refined grain structure and improved mechanical properties.

A still further object of the invention is to provide a method of refining the grain size of sintered steel-bonded titanium carbide composition.

Figure 2:
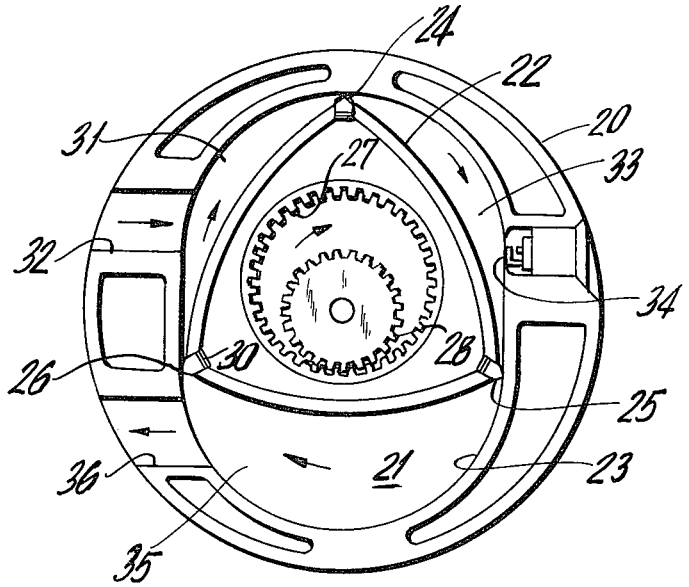

These and other objects will more clearly appear from the following disclosure and the accompanying drawing, wherein:

FIG. 1 is a schematic diagram of a friction and wear testing system smployed in determining the coefficient of friction of steel-bonded titanium carbide compositions relative to a moving surface coated with a wear resistant layer; and FIG. 2 shows schematically a rotary combustion engine utilizing a heat treatable steel-bonded titanium carbide composition as an apex seal material.

STATEMENT OF THE INVENTION

Stating it broadly, one aspect of the invention resides in a steel-bonded titanium carbide composition characterized by a refined grain structure and by an improved combination of mechanical properties, including anti-friction properties, the composition comprising primary grains of titanium carbide (preferably 15% to 60% by weight) dispersed through a steel matrix making up essentially the balance, said steel matrix being characterized metallographically by an austenitic decomposition product, e.g. pearlite, bainite and martensite, said steel-bonded composition containing an effective amount of a grain-growth inhibitor ranging by weight from about 0.25% to 2% of a Group VB carbide, such as columbium carbide, tantalum carbide, and the like.

The foregoing concept is applicable to a broad range of steel-bonded titanium carbide compositions. By way of example, titanium carbide tool steel compositions are disclosed in U.S. Pat. No. 2,828,202 (assigned to the same assignee) comprising broadly primary grains of essentially titanium carbide distributed through a heat treatable steel matrix. A preferred steel matrix is one containing by weight about 1% to 6% Cr, up to about 6% Mo, about 0.3% to 0.8% C and the balance essentially iron. A typical steel-bonded titanium carbide composition is one containing by weight 33% TiC in the form of primary carbide grains dispersed through a steel matrix, the steel matrix containing by weight 3% Cr, 3% Mo, 0.6% C and the balance essentially iron. The steel is preferably produced using powder metallurgy methods comprising broadly mixing powdered titanium carbide (primary carbide grains) with powdered steel-forming ingredients of, for example, the aforementioned composition, forming a compact by pressing the mixture in a mold and then subjecting the compact to liquid phase sintering under nonoxidizing conditions, such as in a vacuum. The term "primary carbide" employed herein is meant to cover the titanium carbide grains per se added directly in making up the composition and which grains are substantially unaffected by heat treatment.

In producing a titanium carbide tool steel composition in accordance with the foregoing patent containing, for example, 33% by weight of TiC (approximately 45 volume percent) and substantially the balance a steel matrix, 500 grams of TiC (of about 5 to 7 microns in size) are mixed with 1000 grams of steel-forming ingredients in a mill half filled with stainless steel balls. To the powder ingredients is added one gram of paraffin wax for each 100 grams of mix. The milling is conducted for about 40 hours, using hexane as a vehicle.

After completion of the milling, the mix is removed and dried and compacts of a desired shape pressed at about 15 t.s.i. and the compacts then subjected to liquid phase sintering in vacuum at a temperature of about 2640°F (1450°C) for about one-half hour at a vacuum corresponding to 20 microns of mercury or better. After completion of the sintering, the compacts are cooled and then annealed by heating to about 1650°F (900°C) for 2 hours followed by cooling at a rate of about 27°F (15°C) per hour to about 212°F (100°C) and thereafter furnace cooled to room temperature to produce an annealed microstructure comprising pearlite in the form of spheroidite (austenitic decomposition product). The annealed hardness is in the neighborhood of about 45 $R_C$ and the high carbon tool steel is capable of being machined and/or ground into any desired tool shape or machine part prior to hardening. This composition generally results in an average carbide grain size of over 5 microns and, for example, as high as 8 to 10 microns.

The hardening treatment comprises heating the machined piece to an austenitizing temperature of about 1750°F for about one-quarter hour followed by quenching in oil or water to produce a hardness in the neighborhood of about 70 $R_C$. The austenitic decomposition product is martensite.

Another type of steel-bonded carbide is that disclosed in U.S. Pat. No. 3,653,982 (also assigned to the same assignee), a typical commercial composition being one containing by weight about 34.5% TiC as primary carbide grains dispersed through a steel matrix making up essentially the balance. The steel matrix contains by weight based on the matrix itself about 10% Cr, 3% Mo, 0.85% C and the balance essentially iron. This steel-bonded carbide differs from the aforementioned lower-chromium variety in that it is capable of being tempered at about 1000°F (538°C) and thus is capable of retaining fairly high hardness at such temperatures, particularly when used as an apex wear resistant seal strip in rotary piston engines, such as the Wankel engine. However, this composition also tends to have coarse grain sizes. The steel matrix composition may range in composition from about 6% to 12% Cr, about 0.5% to 5% Mo, about 0.6% to 1.2% C, up to about 5% W, up to about 2% V, up to about 3% Ni, up to about 5% Co, and the balance essentially iron.

Another steel-bonded carbide composition is one covered by U.S. Pat. No. 3,369,891 (also assigned to the same assignee). A typical composition is one containing by weight 33.2% titanium carbide with the balance a steel matrix containing 18% Ni, 8.5% Co, 4.75% Mo, 1% Ti and the balance essentially iron. The matrix is hardened by first subjecting the steel to a solution treatment by air cooling from a temperature of about 1400°F to 1950°F (760°C to 1100°C) to produce a microstructure in the matrix comprising an austenitic decomposition product characterized by the presence of soft martensite. Thereafter, the matrix surrounding the carbide grains is age hardened by heating it to about 500°F to 1200°F (260°C to 650°C) for about 3 hours. A typical age hardening temperature is 900°F (483°C).

Thus, summarizing the foregoing, the steel matrix may be selected broadly from the group consisting of:

A. a matrix containing by weight about 1% to 6% Cr, about up to 6% Mo, up to about 2% vanadium, up to about 3% cobalt, up to 2% nickel, about 0.3 to 0.8% C and the balance essentially iron, B. a matrix containing by weight about 6% to 12% Cr, about 0.5% to 5% Mo, about 0.6 to 1.2% C, up to about 5% W, up to about 2% V, up to about 3% Ni, up to about 5% Co and the balance essentially iron; and C. a matrix comprising a high nickel alloy containing by weight about 10% to 30% Ni, about 0.2 to 9% Ti, up to about 5% Al, the sum of Ti and Al content not exceeding about 9%, less than about 0.15% C, up to about 25% Co, up to about 10% Mo, substantially the balance of the matrix being at least about 50% iron, the metals making up the matrix composition being proportioned such that when the nickel content ranges from about 10% to 22% and the sum of Al and Ti is less than about 1.5%, the molybdenum and cobalt contents are each at least about 2%, and such that when the nickel content ranges from about 18% to 30% and the molybdenum content is less than 2%, the sum of Al and Ti exceeds 1.5%.

We have found that by adding an effective amount of a grain-growth inhibitor (e.g. TaC) to the steel-bonded titanium carbide composition, the grain size is refined and the properties are markedly improved.

As stated hereinbefore, the effective amount of the grain-growth inhibitor (Group VB carbide) in the composition may range from about 0.25% to 2%. A particularly preferred amount of grain-growth inhibitor is one ranging from about 0.25% to 1%.

As illustrative of the various embodiments of the invention, the following examples are given:

EXAMPLE 1

Tests were conducted on a steel-bonded titanium carbide composition referred to by the trademark "Ferro-TiC C", said composition comprising by weight 33% by weight of TiC and the balance the steel matrix. The steel matrix contains 3% Cr, 3% Mo, 0.6% C and the balance essentially iron. This composition was produced by sintering a compacted mixture at about 1465°C.

To the same powdered composition was added 0.5% by weight TaC. The TaC was added as a master mixture of 90% TiC and 10% TaC to assure a good uniform mixture which was formed into a compact and similarly sintered as above. The results obtained are as follows:

Table 1

| Composition | Density gr/cc | 1750°F 30 min. Oil Q. | 375°F 1 hr. + Air cool Temper | TRS* PSI** | Grain Size |
|---|---|---|---|---|---|
| (1) Ferro-TiC[1] C | 6.60 | 69.8 $R_c$ | 69 $R_c$ | 300,000 | TiC range 4–8 microns Average = 6 microns |
| (2) Ferro-TiC[1] C + 0.5% TaC | 6.61 | 71.5 $R_c$ | 69.3 $R_c$ | 340,000 | TiC Range 1–5 microns Average = 3 microns |

[1]Registered trademark
*Transverse Rupture Strength
**Pounds per Inch²

The transfer rupture strength was determined on a rectangular specimen measuring 0.200 inch ± 0.01 inch thick by 0.250 inch ± 0.01 inch wide by 0.750 inch minimum length. The specimen is supported as a beam on two rods of sintered ground tungsten carbide of 0.125 inch ± 0.001 inch diameter, the two rods being spaced 9/16 inch apart. A load is then applied centrally on the supported specimen sufficient to cause rupture and the transverse rupture strength calculating using the beam formula.

It will be noted from Table 1 that the addition of 0.5% TaC to the composition resulted in an increase in the quenched hardness, a marked increase in the transverse rupture strength and a marked decrease in grain size.

EXAMPLE 2

A steel-bonded titanium carbide composition sold under the trademark Ferro-TiC CM was similarly tested with and without the addition of TaC, the composition comprising 34.5% by weight of TiC and the balance a steel matrix having the following composition: 10% chromium, 3% molybdenum, 0.8% C and the balance essentially iron. The compositions were sintered at a temperature of about 1465°C.

Table 2

| Composition | Density gr/cc | 2000°F 30 min. Oil Q. | 975°F 1 hr. Air Cooled Double | T.R.S. P.S.I. | Grain Size of TiC |
|---|---|---|---|---|---|
| (3) Ferro-TiC* CM | 6.45 | 69 $R_c$ | 67.6 $R_c$ | 260,000 | TiC range 4–8 microns average = 6 microns |
| (4) Ferro-TiC* CM + 0.5% TaC | 6.51 | 71.3 $R_c$ | 68.0 $R_c$ | 270,000 | TiC range 1–5 microns Average: 3 microns |
| (5) Ferro-TiC* CM + 0.75% TaC | 6.52 | 70.9 $R_c$ | 67.4 $R_c$ | 270,000 | TiC range 1–5 microns average = 3 microns |

*Registered Trademark

It will be noted that the addition of 0.5% and 0.75% TaC to the foregoing composition results in a marked refinement of grain size and an increase in the rupture strength and the quenched hardness.

Impact strength properties obtained for compositions (3) [no TaC added] and (4) [0.5% TaC added] showed marked improvement with the addition of TaC to the composition. For example, composition (3) in the quenched and tempered condition exhibited an impact strength of 241 in -lb/in², whereas composition (4) [0.5% TaC] exhibited a much higher impact strength of 323 in-lb/in², an increase of 34% over composition (3).

The impact strength was determined on a specimen measuring 0.200 inch thick by 0.200 inch wide by 0.750 inch long. The specimen is fixed at one end to provide a cantilever, about 0.30 inch of the length being gripped at the fixed end, the portion extending from the fixed end being 0.45 inch long. A specified weight is dropped upon the free end of the canti-levered specimen at different heights until failure occurs.

The impact strength was then measured by multiplying the height in inches by the weight in pounds and the product of the multiplication divided by the cross-sectional area of the specimen (0.04 square inch), the impact strength being given as inch-lbs/in$^2$.

Friction and wear tests showed a marked immprovement in the compositions to which TaC was added.

The coefficient of friction is determined by using a system shown schematically in FIG. 1. A metal ring 10 (e.g. aluminum) is provided mounted on a rotatable arbor 10A, the outside surface of the ring being coated with the hard facing material, e.g. hard chromium, the coating material known by the trademark "Elnisil", and the like. A block 11 of the steel-bonded titanium carbide composition is freely supported on the top of the ring as shown with a predetermined load 12, e.g. 6.6 lbs. applied to the block. The arbor is caused to rotate at 180 rpm and the force of friction 13 then applied via a suitable element to friction load pick-up means 14 which translates the force to a reading on friction load indicator or gage 15. The gage reading is divided by the load 12 on the block to provide the coefficient of friction. In addition, the amount of volumetric wear was measured. The results obtained are as follows:

Table 3

| Block Material | Load | Coeff. of Friction | Volume Loss Cm$^3$ Block | Volume Loss Cm$^3$ Ring | Compatibility |
|---|---|---|---|---|---|
| Ring — "Elnisil" coating on aluminum | | | | | |
| (3) Ferro-Tic* CM | 6.6 | 0.756 | $20\times10^{-5}$ | $64\times10^{-5}$ | Evidence of galling and tendency to adhesive welds |
| (4) Ferro-TiC* CM + 0.5% TaC | 6.6 | 0.228 | $3.1\times10^{-5}$ | $19.8\times10^{-5}$ | No galling |
| (5) Ferro-TiC* CM + 0.75% TaC | 6.6 | 0.151 | $3.1\times10^{-5}$ | $10.1\times10^{-5}$ | No galling |
| Ring — Hard Chromium Plate on Aluminum | | | | | |
| (3) Ferro-TiC* CM | 6.6 | 0.303 | $57\times10^{-5}$ | $12.6\times10^{-5}$ | Some galling |
| (5) Ferro-TiC* CM + 0.75% TaC | 6.6 | 0.151 | $3.1\times10^{-5}$ | $1.4\times10^{-5}$ | No galling |

*Registered Trademark

The tests were run at room temperature at a ring speed of 180 rpm for a period of 40 minutes. The block materials in Table 3 were tested in the hardened and tempered condition. Composition (3) without addition of TaC exhibited a relatively high coefficient of friction of 0.756 which fell to 0.228 with the addition of 0.5% Tac [composition (4)] and even to a lower value of 0.151 with the addition of 0.75% TaC [composition (5)] when tested against "Elnisil". The amount of wear also showed a marked decrease with the additions of 0.5% and 0.75% TaC. Note also that without TaC, the composition shows evidence of galling and of forming adhesive welds.

Similar trends were noted in the test against a hard chromium plate which is also shown in Table 3. Both the coefficient of friction and the amount of wear were markedly reduced.

The composition known by the trademark "Ferro-TiC CM" (34.5% TiC and the balance the steel matrix containing 10% Cr, 3% Mo, 0.8% C and balance Fe) was modified by adding 0.75% CbC by weight to the powder composition prior to sintering. The grain size of TiC following sintering ranged from 1 to 4 microns and had an average size of about 2.5 microns. Thus, CbC behaves similarly to TaC as a grain-growth inhibitor.

The grain-growth inhibiting effect of TaC and/or CbC is obtained so long as the amount of grain-growth inhibitor employed ranges up to about 2% by weight of the steel-bonded titanium carbide composition. For example, in the case of the composition containing 10% Cr, 3% Mo. 0.8% C and the balance Fe, the addition of 3% TaC resulted in substantially little, if any, grain-growth inhibiting effect, the final grain size ranging from about 3 to 7 microns, with the average size about 5 microns.

As stated hereinbefore, the complex sealing system of the rotary combustion engine has placed stringent demands on engineering materials used in component parts thereof. One of the most important components of the sealing system is the apex seal.

Present developments in the rotary combustion engine contemplate the use of an aluminum housing. The rotating piston which has a generally triangular shape is in contact with the end walls of the housing by means of the apices thereof which require the use of a seal material as a seal-off between the spaces defined between the apices. The seal must have wear resistance as well as lubricity. However, the aluminum in the housing is generally soft compared to most materials of construction and has poor wear resistance and requires a coating, such as chromium or "Elnisil" (previously described).

FIG. 2 shows schematically a rotary combustion engine comprising an aluminum housing 20 having a chamber 21 in which is mounted a triangularly shaped rotary piston 22 in sealing contact with the end wall 23 of the chamber at its apices 24 to 26. The rotary piston has an internal gear mounted thereon which is driven by gear 28 mounted on a shaft running perpendicular to the rotary piston. The coating material is applied to end wall 23 as shown by the heavy line to provide sufficient wear resistance to the material of the apices in rubbing contact with the end wall. The material of the apices comprises spring mounted inserts 29 of steel-bonded titanium carbide tool steel maintained in continual sealing contact with the end wall via spring 30.

In operation, as the piston rotates, fuel and air are received at intake zone 31 through intake 32. The fuel-air mixture is then compressed and fired in compression zone 33 via spark plug 34 and the combusted gases at exhaust zone 35 exhausted through outlet 36.

Since the apex seals during operation rub against the very abrasive trochoid surface at varying angles at relatively high stresses, it is important that the seal material fulfill the following requirements:

1. Low coefficient of friction,
2. Relatively low specific gravity to minimize chatter on the trochoid housing,
3. Inherent lubricity to permit the seals to operate at high temperatures,
4. Good strength and resistance to impact,
5. Good wear resistance, and
6. Be compatible with the coating material on the trochoid facing.

The product of the invention fulfills these requirements by providing a unique combination of properties, including low coefficient of friction, relatively low specific gravity, inherent lubricity at elevated temperatures, good strength, improved resistance to wear, improved resistance to impact, etc. Moreover, the product of the invention is compatible as a seal with such hard facing materials as "hard chromium plating" and "Elsinil".

It should be stated that the steel-bonded titanium carbide composition of the invention is additionally advantageous in that it can be used in the production of hard coatings on metal substrates, such as produced by plasma spraying. In this connection, pieces of the sintered material are ground in a ball mill to produce a powder for use in powder spraying, and the like.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A steel-bonded titanium carbide composition formed of primary grains of titanium carbide of average size less than 5 microns dispersed through a steel matrix characterized by an austenitic decomposition product, said composition containing an effective amount of a grain-growth inhibitor corresponding to by weight of about 0.25% to 2% of a Group VB carbide, said composition in the hardened state being characterized by improved anti-friction properties and improved resistance to wear.

2. The steel-bonded titanium carbide composition of claim 1, wherein the amount of titanium carbide in said composition ranges by weight from about 15% to 60%, and wherein said grain-growth inhibitor is selected from the group consisting of columbium carbide and tantalum carbide.

3. The steel-bonded titanium carbide composition of claim 2, wherein said amount of grain-growth inhibitor ranges by weight from about 0.25% to 1%.

4. The steel-bonded titanium carbide composition of claim 2, wherein said grain-growth inhibitor is tantalum carbide.

5. The steel-bonded titanium carbide composition of claim 2, wherein the grain-growth inhibitor is columbium carbide.

6. As an article of manufacture, a hardened wear resistant element made of a steel-bonded titanium carbide composition formed of primary grains of titanium carbide of average size less than 5 microns dispersed through a steel matrix characterized by the presence of martensite, said composition containing an effective amount of a grain-growth inhibitor corresponding to by weight from about 0.25% to 2% of a Group VB carbide, said hardened wear resistant element being characterized by improved anti-friction properties and improved resistance to wear.

7. The hardened wear resistant element of claim 6, wherein the amount of titanium carbide in said composition ranges by weight from about 15% to 60%, and wherein said grain-growth inhibitor is selected from the group consisting of columbium carbide and tantalum carbide.

8. The hardened wear resistant element of claim 7, wherein said amount of grain-growth inhibitor ranges by weight from about 0.25% to 1%.

9. The hardened wear resistant element of claim 7, wherein said grain-growth inhibitor is tantalum carbide.

10. The hardened wear resistant element of claim 7, wherein the grain-growth inhibitor is columbium carbide.

11. The article of manufacture of claim 6, wherein the wear resistant element is an apex seal for rotary engines.

12. A method of inhibiting the grain growth of titanium carbide grains in the production of a sintered, steel-bonded titanium carbide composition containing primary grains of titanium carbide dispersed through a steel matrix making up essentially the balance which comprises, providing a powder mixture of titanium carbide with powdered steel-forming ingredients, including an effective amount of a grain growth inhibitor corresponding to about 0.25% to 2% by weight of a Group VB carbide, compacting said mixture to a desired shape and sintering said shape at an elevated liquid phase sintering temperature of said matrix, whereby the titanium carbide grains in the resulting sintered product are characterized by an average grain size of less than 5 microns, by improved anti-friction properties and by improved resistance to wear by virtue of the presence of said effective amount of said Group VB carbide.

13. The method of claim 12, wherein said steel-bonded titanium carbide composition is produced to contain about 15% to 60% by weight of the titanium carbide based on the total composition, and wherein said grain-growth inhibitor in said composition is selected from the group consisting of columbium carbide and tantalum carbide.

14. The method of claim 13, wherein the amount of grain-growth inhibitor in said composition ranges in weight from about 0.25% to 1%.

15. The method of claim 13, wherein the grain-growth inhibitor in said composition is tantalum carbide.

16. The method of claim 13, wherein the grain-growth inhibitor in said composition is columbium carbide.

* * * * *